United States Patent [19]

Van Erden et al.

[11] Patent Number: 4,666,536

[45] Date of Patent: May 19, 1987

[54] METHOD OF AND MEANS FOR MAKING RECLOSABLE BAG MATERIAL, AND MATERIAL PRODUCED THEREBY

[75] Inventors: Donald Van Erden, Wildwood; Donald W. Noren, Glenview, both of Ill.

[73] Assignee: Signode Corporation, Glenview, Ill.

[21] Appl. No.: 797,989

[22] Filed: Nov. 14, 1985

[51] Int. Cl.[4] ..... B65C 00/00

[52] U.S. Cl. ..... 156/64; 24/576; 24/587; 156/66; 156/191; 156/202; 156/204; 156/378; 156/459; 156/465; 156/499; 383/63; 428/36; 428/57; 428/99; 428/223; 493/214

[58] Field of Search ..... 24/576, 587; 156/64, 156/66, 191, 202, 204, 378, 459, 461, 465, 499; 383/63; 428/36, 57, 94, 223; 493/194, 196, 214, 223

[56] References Cited

U.S. PATENT DOCUMENTS

| | | | |
|---|---|---|---|
| Re. 29,043 | 11/1976 | Naito | 156/251 X |
| 3,789,888 | 2/1974 | James et al. | 141/4 |
| 3,948,705 | 4/1976 | Ausnit | 156/73.4 |
| 4,046,408 | 9/1977 | Ausnit | 285/188 |
| 4,354,541 | 10/1982 | Tilman | 156/66 X |
| 4,355,494 | 10/1982 | Tilman | 53/416 |
| 4,372,793 | 2/1983 | Herz | 156/66 |
| 4,617,683 | 10/1986 | Christoff | 383/63 |

*Primary Examiner*—Robert A. Dawson

*Attorney, Agent, or Firm*—Hill, Van Santen, Steadman & Simpson

[57] ABSTRACT

A method of and apparatus for making, and the resulting material for fabricating reclosable bags and in which a length of web of predetermined width of bag material as wound on a mandrel has fastener strip sections joined to and across the width of the web. The web is adapted to travel continuously spirally about the mandrel. The fastener carrying web may be folded longitudinally and resiliently flexible profiles of the folded fastener strip sections separably joined. Ends of the fastener strips before, and after, folding may be flow melted and fusedly flattened. Ends of the fastener strips may be aligned with a fold juncture of an underturned flange of the web and the margin then unfolded to extend beyond the strip ends.

39 Claims, 20 Drawing Figures

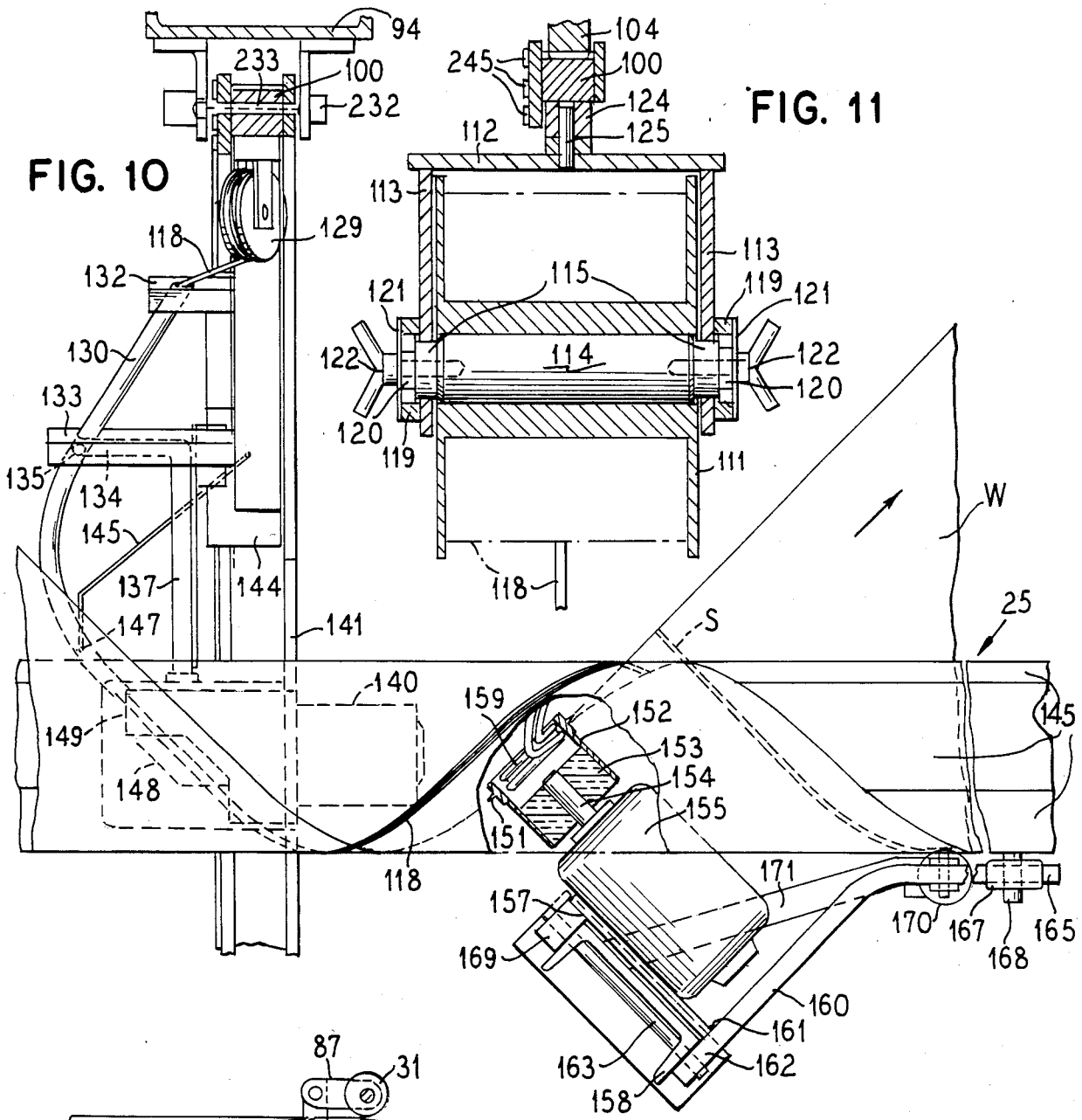
FIG. 10
FIG. 11
94
233
100
232
118
129
132
130
133
135
134
145
137
144
147
141
140
149
148
118
104
245
100
124
125
112
113
113
115
119
121
121
122
122
114
120
120
119
111
118
W
25
S
159
152
153
154
155
151
145
171
157
169
170
167
168
165
160
161
162
163
158
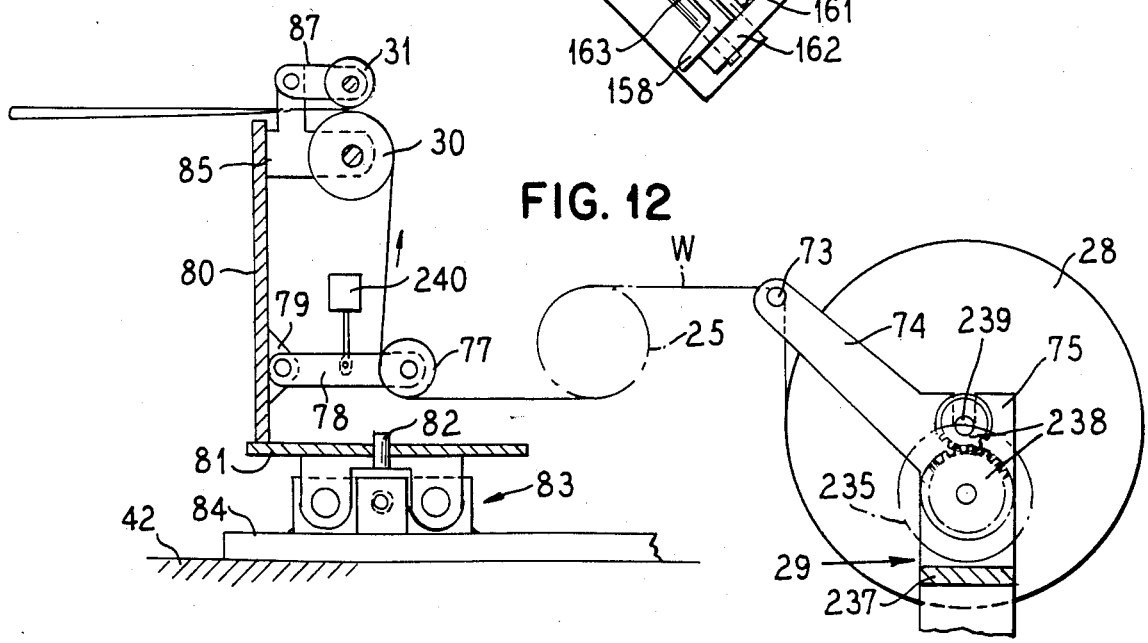
FIG. 12
87
31
30
85
80
240
79
77
78
82
81
83
42
84
W
73
28
74
239
75
25
238
235
29
237

METHOD OF AND MEANS FOR MAKING RECLOSABLE BAG MATERIAL, AND MATERIAL PRODUCED THEREBY

BACKGROUND OF THE INVENTION

This invention relates to the art of reclosable bags of the kind provided with extruded resiliently flexible plastic profiled reclosable separable fastener means, and is more particularly concerned with a new and improved method of and means for making material for such bags, and material produced thereby.

The art of making reclosable bags equipped with extruded plastic profiled reclosable separable fastener means has seen a long period of development as reflected in numerous patent disclosures. It has been conventional practice to extrude plastic material in tubular or strip sheet or web form with the profiled separable fastener means coextruded along and parallel to the longitudinal formation axis of the web, that is, the direction in which the web is extruded. On the other hand, prefabricated separable fastener strip means have been secured to separately formed web but with the fastener strip means extending longitudinally parallel to the longitudinal formation axis of the web, that is, the length of the web as extruded or otherwise formed.

By way of example, U.S. Pat. No. Re. 29,043 is referred to as disclosing coextrusion of web and fastener means and forming the same into bag sections.

U.S. Pat. No. 3,948,705 exemplifies the technique of securing reclosable separable fastener strips to plastic film parallel to the longitudinal formation axis of the web by fusion or heat seal methods.

Attachment of separable fastener strips parallel to the longitudinal formation axis of the web by adhesive means is exemplified in U.S. Pat. Nos. 4,354,541 and 4,372,793.

U.S. Pat. No. 4,046,408 discloses separably interlockable fasteners along the edges of the plastic sheet material having generally arrow shaped profiles, the fasteners being either integrally extruded with flat sheets or tubes of plastic film, or supplied in the form of extruded strips attached to the web or film by heat sealing.

According to all of those prior patent disclosures, it is necessary to provide at least a pair of spaced longitudinally extending complementary profile fastener strips along the longitudinal extent or axis of the bag material web or film so that when the material is folded upon itself along one or more folds parallel to the separable fastener strips, the fastener profiles will be aligned with one another in interlockable relation and extend along the top or bag mouth edges of the bag sections into which the material is subdivided by sealing the same at spaced intervals across the length of the material to provide closed sides for the bag sections.

Where separate matching strips of the web or film material carrying the complementary profile fastener strips longitudinally along the longitudinal extent of the material are aligned in face-to-face relation to provide bag sidewalls, the same requirements must be met according to prior practice as described for the foldable material for fabricating the same into bag sections, except that all side and bottom edges of the bag walls must also be secured together in the completed bags.

Prior techniques do not necessarily limit the length of bags to be produced thereby, that is, the length from the bag top end to the bottom end of the bag, unless the bags are supplied for filling by the type of filling machines commonly referred to as form, fill and seal machines, such as exemplified in U.S. Pat. Nos. 3,789,888 and 4,355,494.

Where the fastener strip means are located longitudinally along the length of the bag making web material as shown in U.S. Pat. No. 4,355,494, the length of the bags that can be produced in the form, fill and seal machines is limited to the diameter of the filling nozzle about which the film or web material is progressively wrapped. Further, unless the fastener profiles are interlocked before the bag forming material is wrapped about the forming extent of the filling nozzle or at least before the usual longitudinal sealing of the joined longitudinal edges or margins of the bag forming material, there is a considerable problem with attaining interlockable registration of the fastener profiles.

According to a novel concept as disclosed in copending application of Paul B. Christoff and Steven Ausnit, Ser. No. 574,878 filed Jan. 30, 1984 (now U.S. Pat. No. 4,617,683) and assigned to the same assignee as the present application, there is provided a reclosable bag and a method of making the same, and method of and means for making material for such bags, wherein the extruded resiliently flexible plastic profiled reclosable fastener means is secured across the length of the bag making material web, instead of along the length of the web as effected according to prior practice. This has numerous advantages, as there pointed out, especially with respect to filling in a so-called vertical form, fill and seal machine.

SUMMARY OF THE PRESENT INVENTION

A principal object of the present invention is to provide a new and improved method of and means for making reclosable bag material of the type provided according to the original concept of the aforesaid pending application for patent.

Another object of the invention is to provide a new and improved method of and means for attaching separable fastener strip across a continuously traveling web of sheet material, and more particularly material for making reclosable bags.

A further object of the invention is to provide new and improved bag making material wherein separable fastener strip extends across the length of a continuous band of bag making film.

Pursuant to the principles of the present invention, there is provided a new and improved method of making reclosable bag material, comprising winding a length of web of predetermined width of bag material on a mandrel, and joining a fastener strip section to and across the width of the web as wound on the mandrel.

There is also provided by the present invention new and improved apparatus for making reclosable bag material, comprising a mandrel; means for winding a length of web of predetermined width of bag material on the mandrel, and means for joining a fastener strip section to and across the width of the web as wound on the mandrel.

The present invention further provides a new and improved material for reclosable bags, wherein extruded resiliently flexible plastic profile reclosable separable fastener strip sections are secured at successive intervals across the length of bag making web, and the ends of the fastener strip sections may be provided at their ends with flow melted, fusedly flattened heat seals to the side margins of the web, or the ends of the fastener strip sections may terminate in spaced relation to the side edges of the web.

BRIEF DESCRIPTION OF THE DRAWINGS

Other objects, features and advantages of the present invention will be readily apparent from the following description of certain representative embodiments thereof, taken in conjunction with the accompanying drawings, although variations and modifications may be effected without departing from the spirit and scope of the novel concepts embodied in the disclosure, and in which:

FIG. 10 is an enlarged fragmentary plan view, partially in section, taken substantially along the line X—X in FIG. 7;

FIG. 11 is a fragmentary sectional elevational view taken substantially along the line XI—XI in FIG. 7;

FIG. 12 is a fragmentary, more or less schematic elevational view partially in section, taken along the irregular section line XII—XII in FIG. 1;

DETAILED DESCRIPTION

Figures 1, 2, 3, 4, 5, 6:
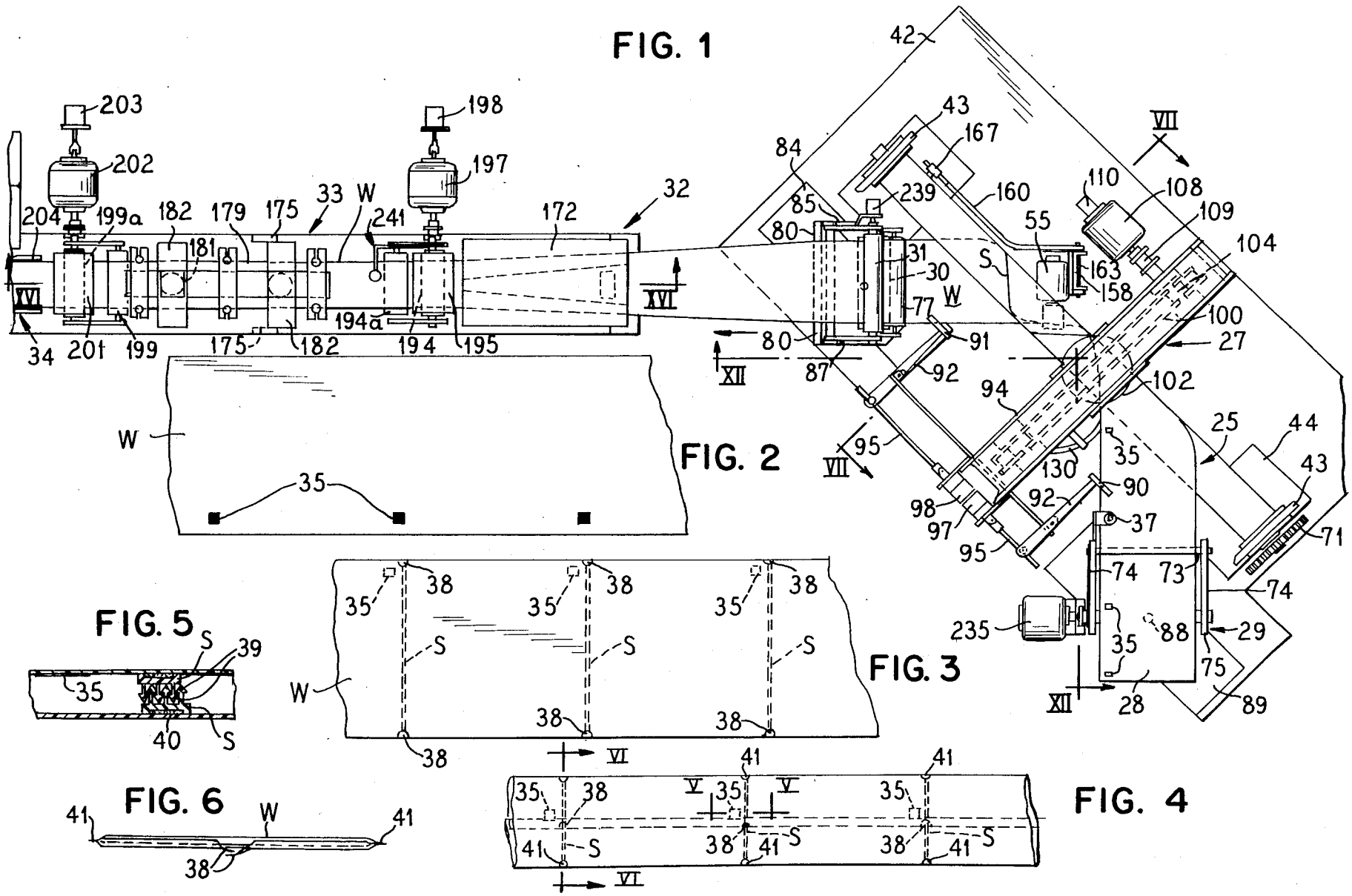
FIG. 1 is a fragmentary, more or less schematic top plan view of apparatus embodying principles of the invention.
FIG. 2 is a fragmentary plan view of the bag making web material as seen at the infeed side of the apparatus in FIG. 1.
FIG. 3 is a top plan view of the bag making material at the outfeed side of the apparatus in FIG. 1.
FIG. 4 is a fragmentary top plan view of the bag making material after folding and being spot sealed in the mechanism shown at the left side of FIG. 1.
FIG. 5 is an enlarged fragmentary sectional detail view taken substantially along the line V—V in FIG. 4.
FIG. 6 is an enlarged fragmentary sectional detail view taken substantially along the line VI—VI in FIG. 4.

According to the present invention, a length of web W (FIG. 1) of predetermined width of bag material is located spirally on and about a mandrel 25, and fastener strip sections S are joined at longitudinally spaced intervals to and across the width of the web on the mandrel, the apparatus including means 27 for this purpose. Although, if preferred, the fastener sections S may be applied to the web W in a stop and go fashion, an advantage of the mandrel manipulation of the web is that the fastener sections S are adapted to be joined across the web at predetermined longitudinal intervals while the web is in continuous travel from a suitable supply roll 28 in a supply reel in a reel mount 29 from which the web is payed out to the mandrel 25, and then guided spirally around the mandrel. After attachment of the fastener sections S to the web, it exits from the mandrel by way of a pinch roll assembly comprising a motorized roll or pulley 30 and cooperating idler roll 31. Downstream from the rolls 30, 31, the fastener carrying web may be directly wound into rolls on take-up reels for subsequent use on vertical form, fill and seal machines, or the web may be folded in a folding mechanism 32. The folded web may then be flow melted, fusedly flattened spot heat sealed in a sonic horn fuse welding device 33 from which the folded ribbon of bag making material proceeds to a take-up reel winding station 34.

Both the web and the fastener strip may be prefabricated extrusions formed from any preferred plastic material or combination of plastic materials as is well known in this art. The web may be a multiplastic laminate, or a laminate of plastic and nonplastic materials. If preferred, the web may be a wholly non-plastic material such as paper or a plastic coated or plastic impregnated non-plastic material.

As delivered to the mandrel 25, the web W may carry printed registration marks 35 (FIGS. 1 and 2), desirably along one margin and on the face of the web which is uppermost as it travels to the mandrel. The marks 35 may accompanying printing (not shown) on the series of web sections which will eventually be separated into individual bags. In the progress of the web W toward the mandrel 25, the registration marks 35 are "read" by a sensor 37 such as a photoelectric eye device which functions in the attainment of proper coordination of various mechanisms of the apparatus for as accurate as practicable placement of the fastener sections S crosswise along the length of the web W, as depicted in FIG. 3. As the strip sections S are successively applied to the web W, they are provided at their ends with flow melted, fusedly flattened heat seals 38 to the opposite longitudinal edges of the web W.

After the web has been longitudinally folded in the folder 32 and spot welded in the sonic horn welder 33, it will appear substantially as shown in FIG. 4. The separable fastener sections S are folded upon themselves and their longitudinally extending resiliently flexible, in this case arrowhead shape, separably interlockable profiles 39 (FIG. 5) interlocked. While the profiles 39 are shown as generally of the type disclosed in U.S. Pat. NO. 4,046,408, the fastener sections S may be secured to the web in accordance with the teachings in U.S. Pat. No. 4,354,541. That is, primary attachment of the sections, to the web W may be by means of adhesive accommodated in an efficient volume layer in a shallow groove 40 extending longitudinally along the back or attachment face of the section.

As best visualized in FIGS. 4 and 6, the web W is folded substantially equally from each opposite side so that the longitudinal margins of the web are overlapped to about the extent of the fused seals 38. In order to maintain a positive folded condition of the ribbon of bag making material into which the web W has been folded, flow melted or fusedly flattened heat seals 41 are desirably formed at the ends of the folded fastener sections S to stabilize the fastener sections at their folds along the sides of the folded web W. This maintains the folded condition for windup of the bag making material ribbon and to facilitate handling. The spot seals 41 are adapted to be produced in the welding device 33.

From the folded condition the flattened, ribbon-like tube of bag making material is adapted to be opened, the separable fasteners separated, and the material handled in a vertical form, fill and seal machine wherein individual bag sections are filled with commodity and the bag sections separated from the bag making material ribbon. In such a machine not only will the opening at the lapping longitudinal margins of the web W be sealed, but the bag making material ribbon will be separated and sealed thereacross adjacent to the fastener sections S so that on each bag section the seal will provide a closed top for the bag and a closed bottom for the next succeeding bag.

Returning now to FIG. 1, details of the apparatus will be described, starting with the mandrel 25 which, together with other components of the apparatus, is for convenience mounted upon a base panel 42. At opposite ends of the elongated mandrel 25 respective standards 43 support the mandrel in suitably spaced relation above the base panel 42. Each of the standards 43 has a stabilizing base pad 44 attached to the base panel 42.

In a preferred construction, the mandrel 25 is mounted non-rotatably but expansively on the standards 43. To this end, the mandrel 25 comprises a substantially cylindrical but expansible shell formed of preferably substantially identical elongate, transversely arcuate shell segments 45 (FIGS. 13–15) disposed in side by side relation and providing the perimeter of the mandrel. At their opposite ends, the mandrel segments 45 are supported on the standards 43 for radial adjustment by means of rectangular terminals 47 radially slidably reciprocatable in complementary radial ways 48 formed in respective annular plates 49 secured concentrically about openings 50 in the associated posts 43 and cooperating with annular retainer disks 51 to retain in position annular bearing assemblies 52 for the associated ends of an arbor 53. Means such as bolts 54 secure the members 49 and 51 to the associated posts 43. The arbor 53 is held by the bearing assemblies 52 rotatably but against axial displacement on and between the posts 43. By selectively rotating the arbor 53, radial movement of the shell segments 45 is adapted to be effected by translating arbor rotation into axial shifting of a motion translation core member 55 which is slightly shorter than the segment members 45 and has a longitudinal bore 57 through which the arbor 53 is received slidably.

Figures 13, 14, 15:
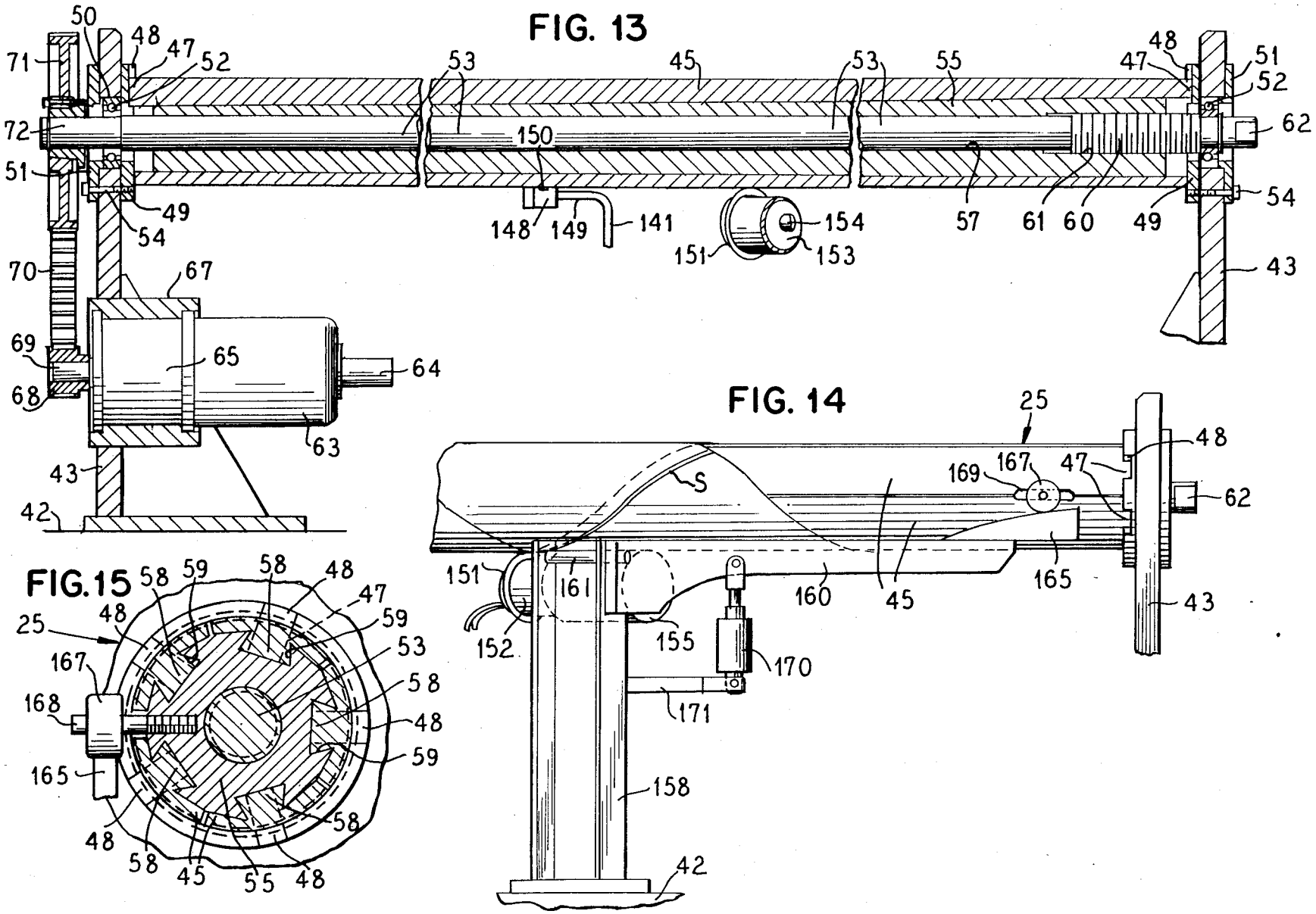
FIG. 13 is a fragmental more or less schematic sectional elevational view taken substantially along the line XIII—XIII in FIG. 7.
FIG. 14 is a fragmentary elevational view taken substantially along the line XIV—XIV in FIG. 7.
FIG. 15 is an enlarged sectional detail view taken substantially along the line XV—XV in FIG. 14.

For effecting radial movement of the segment members 45 in response to axial movement of the core member 55, means are provided comprising on the inner side of each of the members 45 a dovetail gib 58 received in a complementary dovetail way 59 in the perimeter of the core member 55. The gibs 58 and the ways 59 are complementally tapered from one end, herein the right end in FIG. 13, toward the opposite end. Longitudinal movement is adapted to be imparted by the arbor 53 to the core member 55 by means of a screw connection comprising a threaded section 60 of limited length at one end of the shaft of the arbor 53 threadedly engaged with a complementary section of the bore 57 of the core member. Thus, rotating the arbor 53 in rotary one direction causes axial shifting of the core member 55 in one longitudinal direction. Shifting of the core member 55 in the opposite longitudinal direction is effected by turning the arbor 53 in the opposite rotary direction. For example, when the arbor 53 is rotated to shift the core member 55 toward the left as shown in FIG. 13, the mandrel segments 45 are caused to expand radially outwardly and thus expand the diameter of the mandrel 25. Opposite, that is rightward shifting of the core member 55 causes the diameter of the mandrel 25 to contract. For effecting rotation of the arbor 53 manually, one end of the arbor 53 is provided with means such as a slabbed or flatted terminal 62 which is adapted to have a crank (not shown) or wrench applied thereto. This manual adjustment capability is especially useful when setting up the apparatus for running any particular width of the web W, type of web material, and the like which may be most efficiently handled by a particular adjusted diameter of the mandrel 25.

On the other hand, during a continuous running operation, there should be maintained a fine tuned harmony in mandrel function relative to the other relevant mechanisms and functions of the apparatus, so that the web W will travel spirally about the stationary mandrel 25 without binding or undue looseness but freely slide on the mandrel while maintaining an optimum close relationship with respect to the mandrel surface for efficient joining of the fastener sections S to the continuously spirally traveling web W. For effecting such automatic operating adjustments of the mandrel 25, means are provided including a reversible selectively operable motor 63 having an encoder 64 and operating through a ratio gear box 65 mounted in a support 67 carried by the post 43 which supports the end of the arbor 53 opposite its manually operable end. A small diameter pulley 68 is mounted on a drive shaft 69 projecting from the gear box 65 and is operatively coupled by means of an endless flexible driving element, such as a belt 70, with a larger diameter pulley 71 fixed on a terminal 72 on the adjacent end of the arbor 53. Thus, demand operation of the motor 63 is adapted to effect rotation of the arbor 53 in either direction for effecting corresponding axial shifting adjustment of the core member 55 and expanding or contracting the segment members 45 and thereby adjusting the diameter of the mandrel 25 for optimally handling of the spiral travel of the web W thereabout.

Means comprising an automatic web guiding system assures as accurate and consistent as practicable spiral travel of the web W about the mandrel 25. To this end, a guide bar 73 (FIGS. 1 and 12) carried fixedly by arms 74 projecting from the upper ends of upwardly extending web pay out reel supporting arms 75, forming part of the reel mount 29 including a supporting frame, guides the web W from the payout roll 28 substantially horizontally to the top of the mandrel 25.

As the web W leaves or exits from the bottom of the mandrel 25, it is trained to run under and about a dancer roller 77 rotatably mounted on rocker arm structure 78 pivotally connected through bracket structure 79 to a stand 80 rising from a swivel base 81 connected by means of a vertical axle pin 82 to a carriage 83 supported on a base plate 84 resting on the base panel 42.

From the dancer roller 77, the web travels upwardly to and is trained to run over the rotatably driven pinch roll 30 which is rotatably mounted by means of a bracket 85 to the upper end portion of the standard 80. The cooperating pinch roller 31 is mounted by means of rocker arms 87 to the bracket 85.

A swivel mounting for the payoff reel frame 29 may be similar to the swivel mounting for the takeoff drive roll 30, and includes a vertical swivel axle 88 (FIG. 1) and a base plate 89 mounted on the base panel 42.

Both of the swivel mountings may be part of a commercially available automatic web guiding system such as may be obtained from Fife Corporation of Oklahoma City, Okla. This system, in addition to the swivel mountings of the payoff assembly and the exit or takeoff assembly includes an edge guide 90 in engagement with the edge of the web W as it runs toward the mandrel 25, and a similar edge guide 91 in engagement with the edge of the web W in its exit run from the mandrel 25. Each of the edge guides 90 and 91 is mounted on a respective rocker arm 92 intermediately pivotally carried by horizontal bar 93 carried by a frame 94 mounted on the base panel 42. At their ends remote from the edge guides 90 and 91, the arms 92 are connected to respective adjustment screws 95 rotatably controlled by stepper motors comprising a motor 97 for the edge guide 90 and a motor 98 for the edge guide 91. Brackets 99 mount the motors 97 and 98 to the frame 94. Through this arrangement, the edge guides 90 and 91, in cooperation with the swivel mounts for the web input and web output assemblies maintain accurate travel of the web W to and from the mandrel 25.

In a desirable construction, the means 27 for applying the fastener sections S to the web W includes a ring gear 100 (FIGS. 1 and 7) rotatably supported concentrically about the mandrel 25 by means of the upright frame 94 which is generally hoop shaped and rigidly mounted on the base panel 42 by means of brackets 101 and 102. Peripheral gear teeth 103 on the ring gear 100 mesh with suitably spaced supporting and guiding pinions 104, of which there may be three, and each of which has a shaft 105 journaled in bearing blocks 107 carried inside the frame 94. Rotation of the ring gear 100 is effected by means of a motor 108 (FIG. 7 and 8) mounted on the base panel 42 and drivingly connected by means of a coupling 109 to one of the pinions 104. It may be noted that the motor 108 has an encoder 110.

Means are carried by the ring gear 100 for applying the fastener sections S to the web W traveling spirally about the mandrel 25. To this end, there is mounted within the ring gear 100 a fastener or zipper strip supply reel 111 (FIGS. 7, 10 and 11) which is mounted rotatably by means of an inverted U-shaped reel mount comprising a head plate 112 having a pair of spaced legs 113 journalling an spindle 114 carrying the reel. Journal extensions 115 at opposite ends of the spindle 114 are adapted to be received in bearing apertures 117 in the legs 113 by flexing one or both of the arms and thus easing the journals into the bearing apertures.

To avoid overrunning of the reel 111 and thus a continuous length of prefabricated plastic fastener strip 118 on the reel 111, adjustable friction braking means comprising friction rings 119 are held corotative with the arbor 104 by keying disk means 120. The friction rings 119 are caused to thrust against the legs 103 by means of respective compression disks 121 secured by respective thumb screws 122 threaded into the respective ends of the spindle 114, and provide frictional braking engagement with the arm 113 so that the fastener strip 118 can be pulled from the reel 101 under slight tension.

In a preferred construction, the reel mount head plate 112 may comprise a disk (FIG. 1) adapted to be secured as by means of screws 123 to an adaptor block 124 with respect to which the plate 102 is centered by means of a centering pin 125. The block 124 is adapted to be secured to the inner diameter of the ring gear 100 by means of screws 127. For reasonable flexibility in mounting of the reel 111, the ring gear 100 may be provided with a plurality of circumferentially spaced sets of threaded screw holes 128 so that the reel 111 may be located to best advantage for paying out the fastener strip 118.

Figure 7:
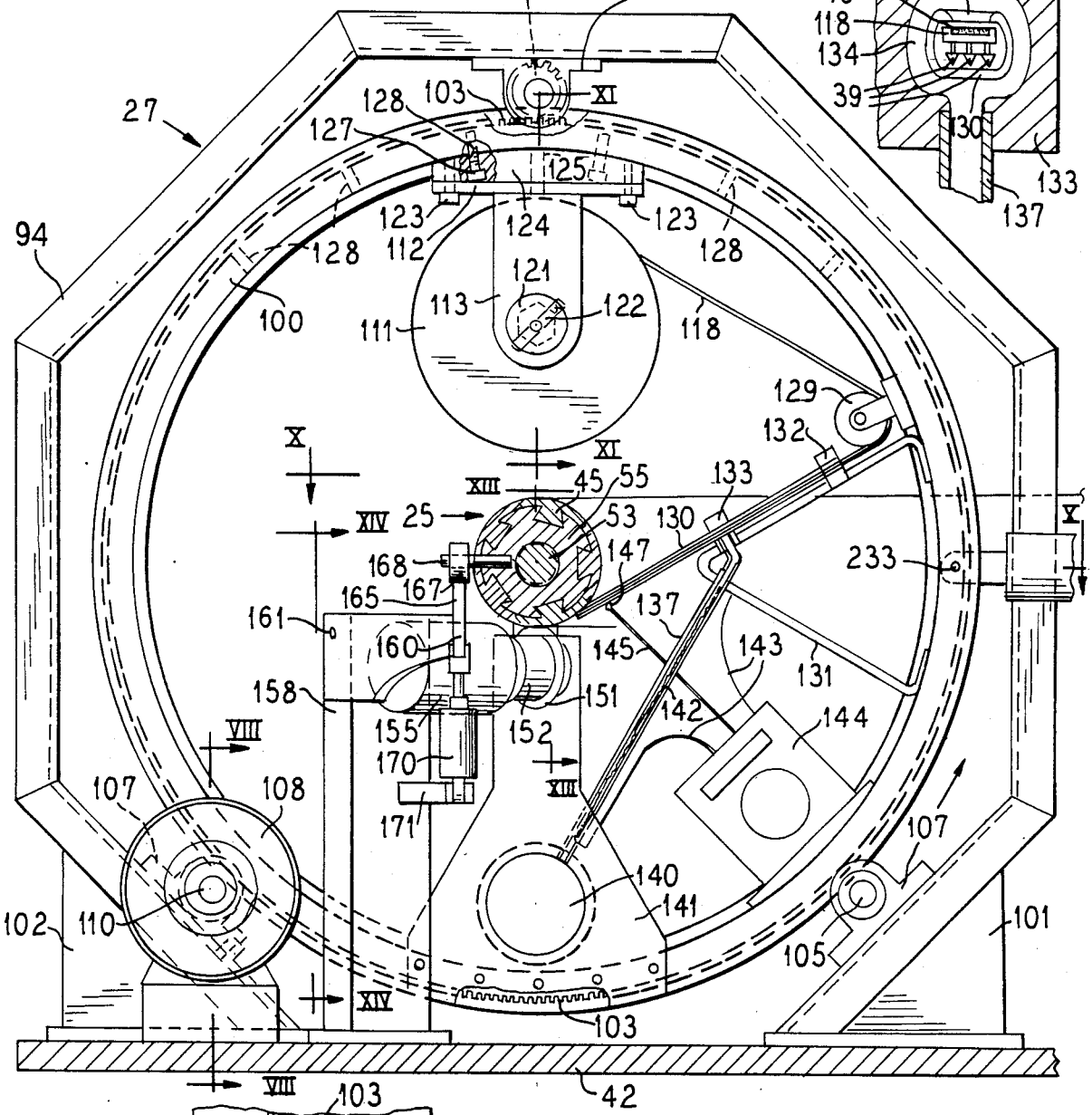
FIG. 7 is an enlarged sectional elevational detail view taken substantially along the line VII—VII in FIG. 1.
Figure 9:
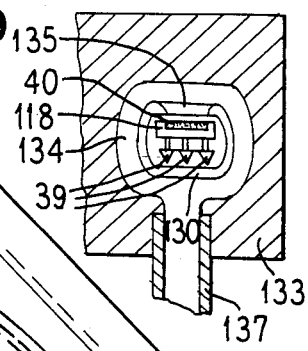
FIG. 9 is an enlarged fragmentary sectional detail view taken substantially along the line IX—IX in FIG. 7.

From the reel 111, the fastener strip 118 extends to and is trained over a pulley 129 mounted on the inner diameter of the ring 100 (FIGS. 7 and 10). From the pulley 129, the fastener strip 118 is guided into the receiving end of an elongate plenum tube 130 mounted on a bracket 131 secured to the inner diameter of the ring 100. At its entrance end, the plenum tube 130 may be secured to the bracket 131 by means of a mounting block 132. Intermediate its length, the plenum tube 130 may be mounted to the bracket 131 by means of a rigid elongated mounting block 133 (FIGS. 9 and 10) which may also serve as a hot gas manifold provided with an internal chamber 134 which communicates through a port 135 in the plenum tube 130 for directing hot gas to the interior or plenum chamber within the tube 130 and particularly toward the back of the fastener strip 118 for reactivating the preferably hot melt adhesive 40 carried by the strip.

Hot gas is adapted to be delivered to the chamber 134 by means of a duct 137 attached at its delivery end to the block 133 in communication with the plenum chamber 134. At its opposite end, the duct 137 communicates with a compressor 140 (FIG. 7) carried by a radial mounting plate 141 secured fixedly to the ring 100. Air from the compressor 140 is directed under pressure through the duct 137 to the chamber 134, and while traveling through the duct 137 is heated to the desired adhesive reactivating temperature by means of an electrical heating coil 142 which is electrically connected as by means of leads 143 to a controller 144 mounted on the inner diameter of the ring 100. A heat probe 145 extending from the controller 144 carries a thermocouple 147 which is located closely adjacent to the fastener strip delivery end of the plenum 130 and assures that the controller will control the heater 142 for continuous attainment of proper heated air conditions within the plenum 130 for efficient reactivation of the hot melt adhesive 40 on the fastener strip 118 as the fastener strip is applied to the spiralling web W on the mandrel 25.

From the discharge end of the plenum 130, the fastener strip 118 is delivered to means for guiding the fastener strip 118 with the reactivated adhesive 40 onto, and assuring proper adherence to, the spiralling web W. Such means desirably comprises a magnetic guiding and presser shoe 148 (FIGS. 10 and 13) mounted on an arm 149 extending from the distal end of the bracket 141. The shoe 148 is magnetic so that it will be constantly attracted toward the contiguous perimeter of the mandrel 25 provided by the segments 45 which are for this purpose formed from a ferromagnetic material. A guide groove 150 in the face of the shoe 148 which confronts the surface of the mandrel 25 receives and guides the fastener strip 118 to and assures adherent engagement of the strip across the spiralling web W.

In order to apply the fastener strip 118 to the spiraling web W, the shoe 148 must travel about the spiraling web, and for this purpose, the ring 100 to which the shoe 148 and the associated equipment is mounted is caused to rotate about the mandrel 25 in the same direction as the direction of travel of the spiraling web about the mandrel, counterclockwised as viewed in FIG. 7. Such rotation is effected by the motor 108 through one of the pinions 104, in the manner previously described.

For severing each fastener strip S from the fastener strip 118 secured across the spiraling web with the aid of the shoe 148, a heated fastener strip compression and parting wheel 151 (FIGS. 7, 10, 13 and 14) severs each successive section S of the fastener strip at the parting between the spirally wound portion of the web W and the portion of the web exiting from the mandrel 25. To this end, the wheel 151 comprises a relatively knife edge annular element carried on a tubular hub 152 mounted corotatively by means of a heat insulating ring 153 on a motor shaft 154 of a prime mover motor 155 carried by an axially adjustable motor mount 157 for attaining accurate adjustment of the wheel 151 with respect to the web parting line. For supporting the motor mount, a vertical post 158 is fixedly mounted on the base plate 42.

For heating the parting wheel 151, means comprising an induction heater coil 159 is located within the tubular hub 152 in alignment with the wheel 151. Thus, as the web W travels past the wheel 151 located rotatably in an adjusted fixed position, preferably below the mandrel 25, not only does the wheel 151 cutoff each successive zipper or separable fastener section S from the fastener strip 118 which has been applied with the aid of the shoe 148 to the web W wound on the mandrel 25, but the wheel also effects the melt flow positive anchoring flattened seals 38 at the ends of the sections S.

In order to function properly, the cut-off wheel 151 must have its fastener strip cutting edge in fairly closely nipping but non-contacting relation to the adjacent perimeter of the mandrel 25, and more particularly the mandrel segments 45 overlying the wheel which is rotatably driven in operation by the motor 155. On the other hand, diametrical adjustments of the mandrel 25 are adapted to be effected as already described, and therefore to maintain a proper cutting relationship to the mandrel and the fastener carrying web, nipping adjustments of the wheel 151 relative to the mandrel 25 must be effected corresponding to the mandrel diameter adjustments. To this end, means are provided for automatically adjusting the nipping relationship of the wheel 151. Conveniently, such adjusting means comprises a lever arm 160 of generally dogleg shape in plan (FIG. 10) and which at its proximal end is fixedly attached as by means of welding 161 to the motor carriage 157 with a terminal portion 162 of the arm connected to one end portion of a pivot pin or shaft 163 extending through the upper end portion of the post 158 and having an opposite end portion to which a block 164 on the motor carriage 157 is attached. Through this arrangement, rocking adjustments of the lever arm 160 effect corresponding radial adjustments of the motor 155 and the compression and cutoff wheel 151.

To synchronize rocking adjustments of the lever arm 160 with diametrical adjustments of the mandrel 25, cam and follower means are provided, comprising a cam 165 (FIG. 14) mounted fixedly on the distal end of the arm 160 and engaging a cam follower wheel 167 (FIGS. 10, 14 and 15) rotatably mounted on a pintle 168 extending through an elongate longitudinally extending clearance slot 169 between adjacent ones of the segments 45 and secured fixedly in radial orientation to the axially adjustable core member 55. Biasing means such as an air spring 170 extending between the arm 160 and a bracket 171 on the post 158 maintain an upward bias on the arm 160 for maintaining an operating engagement of the cam 165 with the wheel 167. Through this arrangement, any axial adjustment of the core member 55 for adjusting the diameter of the mandrel 25 is synchronously translated into conformable adjustment of the compression and cut-off wheel 151. That is, when the core member 55 is adjusted toward the right as viewed in FIG. 14 to decrease the diameter of the mandrel 25, sychronized rocking of the lever arm 160 in a clockwise direction effects upward adjustment of the wheel 151. On the other hand, leftward adjustment of the core member 55 for increasing the diameter of the mandrel 25 causes corresponding counterclockwise swinging of the lever arm 160 and thus effects corresponding downward adjustment of the wheel 151.

Figure 16:
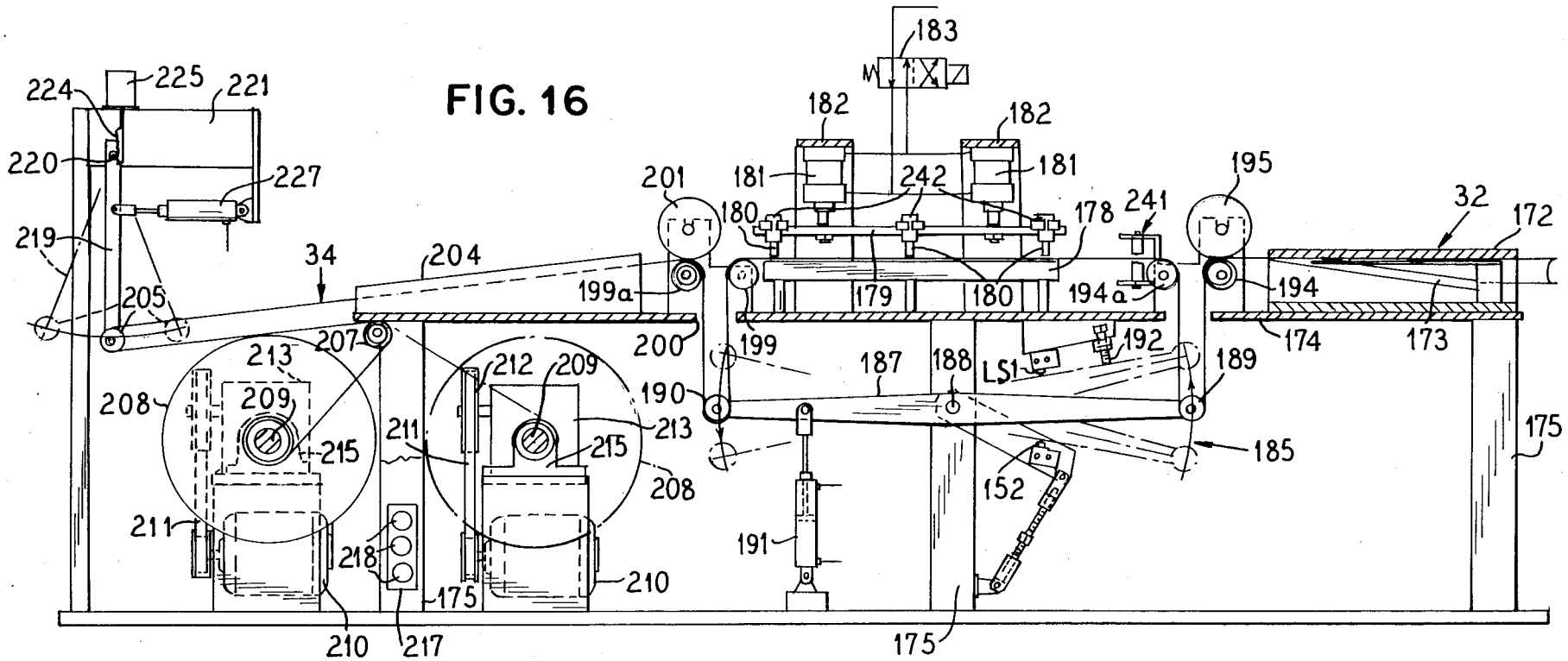
FIG. 16 is a fragmentary, enlarged, more or less schematic vertical sectional detail view taken substantially along the line XVI—XVI in FIG. 1.

After the web W carrying the series of fastener strip sections S exits from the mandrel 25 and passes the driving pinch roll 30, it enters a tunnel 172 (FIG. 16) of the folder 32 and is folded by means of a folding plough device 173. Conveniently, the tunnel 172 together with mechanism of the ultrasonic spot welding station 33 may be mounted on a table 174 supported by means of posts 175 on a base panel 177 which may be in one piece as shown or may be in a plurality of pieces, if preferred. From the folder 32 the folded web travels to the spot welding station 33 where the web is supported on an anvil 178 which is vertically reciprocatably operable a welding head 179 carrying a plurality, herein three, longitudinally spaced sets of tranversely spaced pairs of ultrasonic welding horns 180 properly located for effecting the seals 41 at the edges of the folded web referred to in connection with FIG. 4.

For reciprocating the welding head 179 between lowered welding position and raised inactive position relative to the anvil 178, a pair of fluid (such as air) operated actuators 181 is provided carried by frame means 182 mounted on the table 174. Pressure fluid for operating the actuators 181 for raising and lowering the welding head 179 is adapted to be supplied from any suitable source and controlled by means of a 4-way valve 183 operated by means of a solenoid 184 in timed relation with advance of each succeeding area of the folded web W to be spot welded by means of the ultrasonic horns 180.

Means are provided for effecting dwell and advance of the successive areas of the folded web W to be welded while the web otherwise remains in constant onward traveling motion at each side of the spot welding station 33. To this end, means comprising a dancer arrangement 185 controls the intermittent movement of the folded web through the welder. The dancer arrangement 185 comprises a rocker arm 187 connected by means of an intermediate horizontal pivot 188 extending between a pair of the posts 175 under the table 174. At one end, the arm 187 has a pulley 189 around which a downward input loop of the folded web is engaged at the upstream side of the welder. At its opposite end the arm 187 has a pulley 190 about which a downward output loop of the folded web engages at the downstream side of the welder.

Rocking operation of the arm 187 is adapted to be effected by means of a fluid (e.g. pneumatic) operated actuator 191 which is operated cyclically in any preferred manner as is common with this type of actuator for cyclically rocking the arm 187 as indicated by the alternate phantom positions as compared with the depicted horizontal position which is shown merely for illustrative purposes and is not to be considered an operating position. An adjustable safety stop 192 may be provided under the table 174 to avoid overrunning of the folded web from proper registration with the welding horns 180.

The input web loop extends down through a hole 193 in the table 174 from a driven roll 194, which cooperates with a pinch roll 195 and is driven by a helper motor 197 having coupled thereto a tachometer generator 198. Guidance of the web from the input loop to the table 178 is by an idler guide roller 194*a*. This arrangement assures a steady step-by-step input of the continuously running folded web.

At the output or downstream side of the welder 33, a similar arrangement comprises an idler guide roller 199 which guides the welded web to the output loop which extends down through a hole 200 in the table 174. The opposite end of the output loop is engaged by a driven roll 199*a* cooperating in nipping relation with a pinch roller 199*a* for continuing travel of the folded web at substantially the same rate of speed as it entered the welder at the pinch roll 195. Driving of the pinch roll 201 is effected by means of a helper motor 202 having coupled thereto a tachometer generator 203.

On leaving the welder 33, the folded and welded web W passes through a channel guide 204 comprising part of the wind up station 34. After looping about a dancer roller 205, the web W is guided by a roller 207 to a selected take up or storage reel 208 mounted on either of a pair of alternate take up reel spindles 209. Each of the spindles has associated therewith driving means including a motor 210 and a power transmission including an endless flexible connector 211 driven by the motor and trained over a driven pulley 212 of a transmission gear mechanism within a box 213 carried by a mounting frame structure 214 which supports bearing block means 215 for the spindle 209. A motor control panel 217 may be conveniently mounted on one of the adjacent posts 175 and provided with control buttons 218 comprising a "stop" button and a respective button for each of the take up reel driving motors 210.

As shown, the dancer roller 205 is carried by a depending rocker arm 219 connected by means of a pivot 220 to an overhead support 221 which may be mounted on the base 177 by means of a post 222. Fixed to the arm 219 concentric with the pivot 220 is a pinion 223 which meshes with a vertically extending rack 224 connected to a transponder 225 which controls voltage to the winding reel motors 210 for controlling the winding torque for the take up reels. A fluid actuator 227 mounted to the overhead frame support 221 is adapted to control the dancer arm 219 within its indicated operating range.

It will be appreciated that all of the various operating mechanisms involved in handling and processing the web W from the supply station comprising the payout reel 28 to the wind up reels 208 in the wind up station 34 must be coordinated for attaining the desired results of substantially accurate attachment of the fastener strip sections S to the web W at the desired bag length intervals, and then final spot welding in the welding station 33 and winding in the winding takeup station 34, as a continuous high speed process which may involve running speeds up to 120 feet per minute. To this end, various and sundry state of the art integrating, synchronizing and control devices are adapted to be utilized in and in connection with the described apparatus, and which may be referred to herein only sketchily and schematically but which are well known to those skilled in the art of automation.

Figure 17:
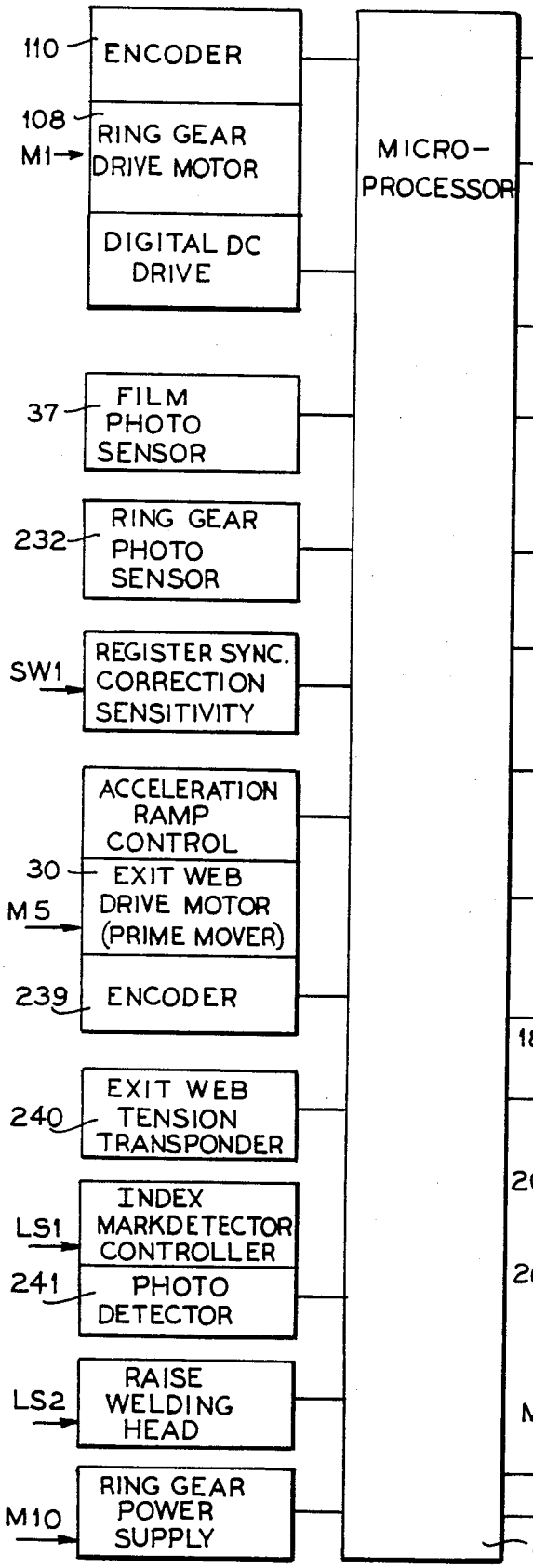
FIG. 17 represents a machine operation computerized controller in block diagram.

Overall automatic operation may be effected by means of a microprocessor or computerized controller 230 (FIG. 17) for integrated system operation of the apparatus. For convenience in tracing the various control functions monitored through the controller 230, the description will follow as nearly as practicable down the schematic columnar representation of the controller in FIG. 17.

M1 relates to the ring gear drive motor 108 and its associated encoder 110 and indicates that this motor has a digital DC drive. The film photosensor 37 feeds its intelligence to the controller 230. A photosensor 232 (FIGS. 7 and 10) is pulsed in each rotary cycle of the ring gear 100 by registration of a hole 233 for photocell sensor pickup. The encoder 110 controls pulse count differential between the photosensors 37 and 232. This controls the direction of rotation of the arbor drive motor 63 (block M2) to expand or contract the mandrel (25) diameter according to a manual control at a suitably located control panel (not shown) and which controls the magnitude (response speed) of the mandrel diameter adjustment arbor screw 60 on the arbor 53 (FIG. 13).

M3 and M4 relate to respectively the guide screw drive motor 97 and the guide screw drive motor 98 (FIG. 1) and the associated sensors 90 and 91, respectively. The sensors 90 and 91 adjust the attack angle of the web W by controlling the steering devices for the web supply reel 28 and the takeoff pinch rolls 30, 31 through respective servovalves in the commercially available (Fife) device, as indicated in the diagram in FIG. 17, but not otherwise shown.

The payoff reel for the payout roll 28 is desirably provided with rotation control means comprising a magnetic particle brake 235 (FIGS. 1 and 12) mounted on a shelf bracket 237 carried by the frame 75 and coupled by means of a gear train 238 to a spindle shaft 239 mounting the payoff roll reel.

M5 relates to the prime mover motorized exit web take off prime mover motorized pinch roll 30 which has associated therewith an encoder 239 (FIG. 1) and an acceleration ramp control (not shown). The prime mover 30 determines the system speed and is critical to the operation of the payoff reel magnetic brake 235. Top system speed is adapted to be controlled at the control panel (not shown) for constant ramp up from about 1/6 maximum speed. The dancer 77 (FIG. 12) upstream from the prime mover 30 detects friction of capstan effect, payoff reel, etc., and is attached to a transponder 240 which is adapted to control the payoff reel magnetic particle brake 235.

M6 relates to the zipper compression and parting wheel drive motor 155 (FIG. 10), and which motor may be of the slow-syn type. This motor is adapted to be controlled by adjustable AC frequency from a supply output, and may be equipment for this purpose obtainable from Lovejoy, Inc. of Downers Grove, Ill.

The controller 230 is substantially involved with the welder 33 (FIGS. 1 and 16) in synchronizing its functions in the overall system. This includes the welder head controlling solenoid 184 and the pinch roll drive motors 197 and 202. Thus, the input pinch roller motor 197 is controlled by a controller module M7 in cooperation with its tachometer generator 198. Similarly, the output pinch roller 202 is controlled by a controller module M8 in cooperation with its tachometer generator 203.

A photodetector 241 (FIG. 16) mounted to observe the indexing spots 35 on the folded web after the web leaves the guide roller 194*a* is adapted to be armed through a switch LS1 located to be operated by the upswinging web input portion of the rocker arm 187. Thereby, the photodetector 241 determines when to lower the carriage 179, and when to activate the ultrasonic welding horns 180 through respective transducers 242 associated therewith. At the end of the downswing of the web input portion of the arm 187 it operates a switch LS2 causing the welder head control 184 to reverse and raise the welder head. Although the ultrasonic horns 180 are normally timed to turn off after a proper welding interval, the switch LS2, as a safety measure, assures that the ultrasonics for the horns 80 are positively turned off.

In addition, of course, the controller 230 controls through module M9 the take up reel drive motors 210 which may have conventional tachometer generators operatively associated therewith.

Figure 8:
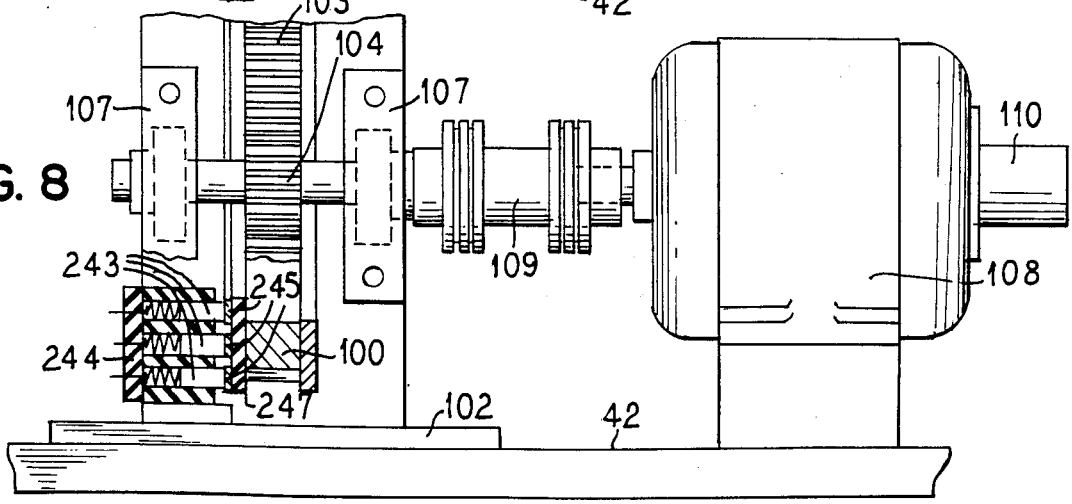
FIG. 8 is an enlarged fragmentary sectional elevational view taken substantially along the line VIII—VIII in FIG. 7.

Although power supply for the electrical equipment carried by the ring gear 100 may be otherwise controlled, such as manually, in a preferred mode the controller 230 may be relied upon to control the power supply automatically coordinated with the overall system, such as energizing at started up and deenergizing at sheet down. This may involve a module M10. A power supply connection to the ring gear may be effected as shown in FIG. 8 by means of electrically conducting brushes 243 carried by holder 244 mounted on the base plate 102 in operative relation to one face of the ring gear and contacting in power transfer relation electrically conducting take off rings 245 mounted corotatively on a dielectric annular mounting plate 247 secured to the face of the ring 100.

Figure 18:
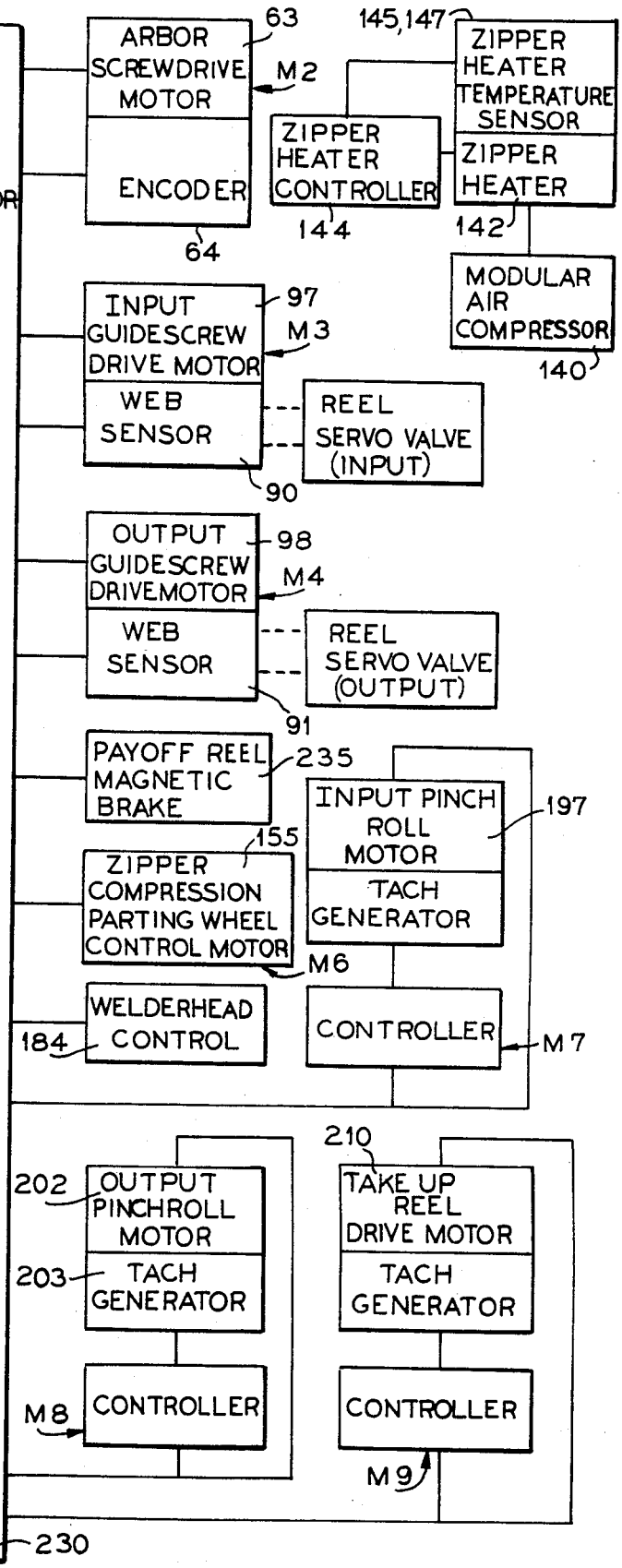
FIG. 18 is a block diagram in respect to the plastic fastener or zipper heat conditioning means related to the apparatus of FIG. 7.

In FIG. 18 is schematically shown the general relationship of various components of the zipper heater relatively self-contained sub-system carried within the rotary ring 100 for heating the fastener or zipper strip 118. Electrical supply is, as previously described under the control of the controller 230.

Figure 20:
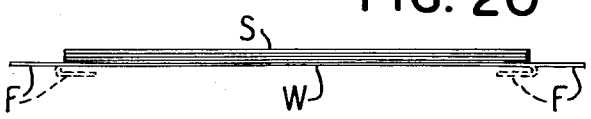
FIG. 20 is a schematic view showing how the ends of the zipper sections are spaced from the edges of the web after the web margins have been straightened out from the folded condition shown in FIG. 19.
Figure 19:
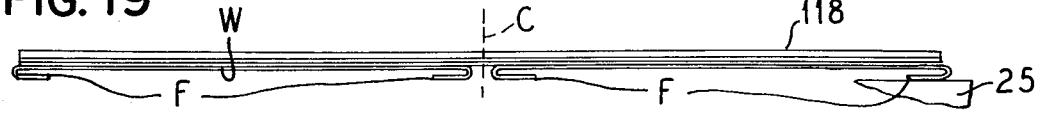
FIG. 19 is a schematic illustration showing how the fastener strip sections can be applied with their ends spaced from the side edges of the web.

Although electrical wiring has not, for the most part, been specifically disclosed in relation to the various described electrical devices, such wiring may be conventional and its realization will be fully understood by any competent electrically skilled person, without any necessity for specifically encumbering the present disclosure.

Where it is desired to have the ends of the zipper strips S extend short of the edges of the web W, that is so as to provide a predetermined marginal width at the sides of the web extending beyond the ends of the zipper strips, the method of applying the zipper strips to the film web may be modified as exemplified in FIGS. 19 and 20. To this end, before the web W is directed about the mandrel 25, the desired widths of the margins of the web which it is desired to have extend beyond the ends of the fastener strips S are folded under as shown at F, onto the face of the web W opposite to that at which the zipper strip 118 is applied in the progress of the web through the applicator 27. Then, by having the web with folded margins spiral about the mandrel 25 with the loops of the web in generally edge-to-edge relation at the point of application of the zipper strip 118, and separation of the continuous zipper strip 118 into the individual strips S by cut off C between the adjacent web edges, just the desired length of the zipper strips S will be present at each interval along the web W. Then by unfolding the margins of the web into a flat condition as shown in FIG. 20, the opposite ends of the zipper strip S will be spaced as desired from the edges of the web. Having the margins of the web free is advantageous for attaining the overlapped marginal relationship when the web W is folded upon itself as demonstrated in FIGS. 4 and 6.

It will be understood that variations and modifications may be effected without departing from the spirit and scope of the novel concepts of the present invention.

We claim as our invention:

1. A method of making reclosable bag material, comprising:

winding a length of web of predetermined width of bag material on a mandrel;

and joining a fastener strip section to and across the width of the web as wound on the mandrel.

2. A method according to claim 1, which comprises moving said web continuously lengthwise, and effecting said winding and joining of fastener strip section thereacross while the web is in the continuous lengthwise movement.

3. A method according to claim 2, which comprises directing a continuous fastener strip from a supply mounted on a carrier and rotatably concentrically about said mandrel where said web is wound spirally about the mandrel, rotating said carrier in coordinated relation to the rate of travel of said web, and directing said fastener strip toward the spirally wound web on the mandrel and applying successive fastener strip sections to the spirally wound traveling web at predetermined spaced intervals along and across the width of the spirally wound web.

4. A method according to claim 3, which comprises supplying said fastener strip with reactivatable adhesive thereon, and applying heat for reactivating the adhesive in transit of the fastener strip from said supply to said spirally wound web on the mandrel.

5. A method according to claim 4, which comprises running said fastener strip through a heating tunnel for effecting reactivation of said adhesive.

6. A method according to claim 4, which comprises guiding and pressing the fastener strip into joined and adhesively secured relation to the spirally wound web by applying a shoe carried by said carrier to the fastener strip for effecting said joining and pressing of the fastener strip to said spirally wound web.

7. A method according to claim 6, which comprises applying cut-off heat and pressure to and across said fastener strip at the mandrel for separating each fastener strip section from the strip.

8. A method according to claim 7, which comprises applying said cut-off heat and pressure by pressing a heated rotary cut-off wheel to and across the fastener strip along a longitudinal edge of the web.

9. A method according to claim 8, which comprises effecting diametric adjustments of said mandrel, and effecting simultaneous radial adjustments of said wheel relative to the perimeter of the mandrel for maintaining a predetermined relationship of said edge to the mandrel.

10. A method according to claim 7, which comprises in the application of said cut-off heat and pressure sealing and flattening the cut-off ends of said fastener strip to the edge of the web.

11. A method according to claim 1, which comprises directing the web from a continuous supply toward one side of said mandrel, effecting said winding of the web spirally about the mandrel, transporting the web after said winding away from said one side of said mandrel, and effecting continuous travel of the web from said supply and spirally about the mandrel and in transport away from the mandrel.

12. A method according to claim 11, which comprises controlling the web in movement toward and away from the mandrel for maintaining substantially accurate spiral winding of the web about the mandrel.

13. A method according to claim 11, which comprises supplying said web with index marks at bag length intervals along its length, and in the travel of the web sensing said marks and coordinating joining of successive fastener strip sections to the traveling web as spirally wound on the mandrel.

14. A method according to claim 1, which comprises supplying the web in a continuous length, effecting continuous travel of the web spirally about the mandrel, joining successive fastener strips at predetermined spaced intervals along the web as the web travels spirally about the mandrel, and folding the web after leaving the mandrel and folding the fastener strip sections upon themselves and separably interlocking separable fastener profiles on the strips.

15. A method according to claim 14, which comprises spot welding the opposite ends of the folded fastener strips together.

16. A method according to claim 15, which comprises after said welding winding the folded web onto take-up reels.

17. Apparatus for making reclosable bag material, comprising:

a mandrel;

means for winding a length of web of predetermined width of bag material on said mandrel;

and means for joining a fastener strip section to and across the width of said web as wound on the mandrel.

18. Apparatus according to claim 17, which includes means for moving said web continuously lengthwise, including said winding, and said means for joining operating to join the fastener strip section while the web is in continuous lengthwise movement.

19. Apparatus according to claim 18, including means for directing a continuous fastener strip from a supply mounted on a carrier, means for mounting said carrier rotatably concentrically about said mandrel where said web is wound spirally about the mandrel, means for rotating said carrier in coordinated relation to the rate of travel of said web, said directing means being operative to direct the fastener strip toward the spirally wound web on the mandrel, and means for applying successive fastener strip sections to the spirally wound traveling web at predetermined spaced intervals along and across the width of the spirally wound web.

20. Apparatus according to claim 19, wherein said fastener strip has reactivatable adhesive thereon, and means for applying heat for reactivating the adhesive in transit of the fastener strip by means of said directing means from said supply to the spirally wound web on the mandrel.

21. Apparatus according to claim 20, wherein said means for applying heat comprises a heating tunnel through which the strip is conducted for effecting said reactivation of said adhesive.

22. Apparatus according to claim 20, including means for guiding and pressing the fastener strip into joined and adhesively secured relation to the spirally wound web and including a shoe carried by said carrier.

23. Apparatus according to claim 22, which includes means for applying cut-off heat and pressure to and across said fastener strip at the mandrel for separating each fastener strip section from the strip.

24. Apparatus according to claim 23, wherein said cutoff heat and pressure applying means comprises a heated rotary cut-off wheel applied to and across the fastener strip along a longitudinal edge of the web.

25. Apparatus according to claim 24, including means for effecting diametric adjustments of said mandrel, and means for effecting simultaneous radial adjustments of said wheel relative to the perimeter of the mandrel for maintaining a predetermined relationship of said edge to the mandrel.

26. Apparatus according to claim 24, wherein said wheel includes means for heat and pressure sealing and flattening cut-off ends of said fastener strip to the edge of the web.

27. Apparatus according to claim 17, which includes means for directing the web from a continuous supply toward one side of said mandrel where the web is spirally wound about the mandrel, and means for transporting the web after said winding away from said one side of said mandrel, said directing means and said transporting means being coordinated for effecting continuous travel of the web from said supply and spirally about the mandrel and in transport away from the mandrel.

28. Apparatus according to claim 27, including means for controlling the web in movement toward and way from the mandrel for maintaining substantially accurate spiral winding of the web about the mandrel.

29. Apparatus according to claim 27, wherein said web carries index marks at bag length intervals along its length, and means for sensing said marks in the travel of the web and for coordinating joining of successive fastener strip sections to the traveling web as spirally wound on the mandrel.

30. Apparatus according to claim 17, including means for supplying the web in a continuous length, means for affecting continuous travel of the web spirally about the mandrel, said means for joining being operative to join successive fastener strips at predetermined spaced intervals along the web as the web travels spirally about the mandrel, and means for folding the web after leaving the mandrel and thereby folding the fastener strip sections upon themselves for separably interlocking separable fastener profiles on the strips.

31. Apparatus according to claim 30, including means for welding the opposite ends of the folded fastener strips together.

32. Apparatus according to claim 31, including take-up reel means for receiving the folded and welded web.

33. Bag making material in the form of a continuous ribbon web having extending thereacross from longitudinal side to longitudinal side and at longitudinally spaced intervals therealong resiliently flexible profile fastener strip sections, and comprising:

at least one of the ends of said sections being flow melted and fusedly flattened.

34. Bag making material according to claim 33, wherein both opposite ends of said sections are flow melted and fusedly flattened.

35. Bag making material according to claim 33, wherein said web and said sections are folded upon themselves, and the opposite ends of the folded fastener strip sections are flow melted and fusedly flattened.

36. Bag making material according to claim 34, wherein said web and said fastener strip sections are folded upon themselves, and the opposite ends of the folded fastener strips are flow melted and fusedly flattened.

37. Bag making material according to claim 36, wherein said web and fastener strip sections are folded upon themselves from opposite sides of the web, and with the original margins and original flow melted and fusedly flattened ends of the fastener strips in loosely overlapping relation.

38. A method according to claim 1, which comprises folding under a longitudinal margin of the web, effecting said joining of the fastener strip section with an end of the strip section aligned with a fold joint where the folded margin joins the web, and unfolding the margin to project beyond said end of the strip.

39. A method of making reclosable bag material, comprising:

folding under at least one margin of web material along a side edge so that a fold juncture results where the margin joins the remainder of the web;

assembling with and joining to the web a separable fastener strip extending across the web with an end of the strip aligned with said juncture;

and unfolding the margin to project beyond said strip end.

* * * * *